United States Patent [19]

Williams

[11] 4,126,489

[45] Nov. 21, 1978

[54] METHOD OF MAKING CATHODE HEATERS

[75] Inventor: Paul D. Williams, Portola Valley, Calif.

[73] Assignee: Varian Associates, Inc., Palo Alto, Calif.

[21] Appl. No.: 597,954

[22] Filed: Jul. 21, 1975

Related U.S. Application Data

[63] Continuation of Ser. No. 380,013, Jul. 17, 1973, abandoned, which is a continuation of Ser. No. 41,720, May 27, 1970, abandoned, which is a continuation of Ser. No. 621,194, Mar. 7, 1967, abandoned.

[51] Int. Cl.[2] ..... C23C 11/02; C23C 11/08

[52] U.S. Cl. ..... 148/6.3; 427/111; 427/117; 427/118; 427/120; 427/123; 427/126; 427/229; 427/318; 427/319; 427/327; 427/343; 427/372 R; 427/399; 427/419 A

[58] Field of Search ..... 427/77, 318, 111, 117, 427/120, 123, 126, 229, 328, 343, 327, 372 R, 399, 419 A, 319, 118; 148/6.3

[56] References Cited

U.S. PATENT DOCUMENTS

| | | | |
|---|---|---|---|
| 1,699,639 | 1/1929 | Van Gessel | 427/317 |
| 2,151,797 | 3/1939 | Prescott, Jr. | 427/74 |
| 2,161,790 | 6/1939 | Abadie | 427/77 |
| 3,195,004 | 7/1965 | Hassett | 313/340 |
| 3,401,297 | 9/1968 | Feinleib | 313/340 |
| 3,450,565 | 6/1969 | Theodosopoulos et al. | 427/123 |

*Primary Examiner*—Cameron K. Weiffenbach
*Attorney, Agent, or Firm*—Stanley Z. Cole; Robert K. Stoddard

[57] ABSTRACT

A method of improving the thermal emmissivity of a cathode heater wire to allow lower temperature operation of the heater without an attendant lowering in the cathode operating temperature, in which method the surface of a tungsten or molybdenum wire is oxidized, then coated with a salt of a refractory metal, and finally heated to reduce the salt and oxide to their metallic forms thereby causing the heater wire to be roughened and darkened.

8 Claims, 3 Drawing Figures

INVENTOR.
PAUL D. WILLIAMS
BY
Robert W. Dilts
ATTORNEY

METHOD OF MAKING CATHODE HEATERS

BACKGROUND OF THE INVENTION

The present application is a continuation of my abandoned application Ser. No. 380,013, which is a continuation of Ser. No. 41,720, now abandoned, which is a continuation of abandoned Ser. No. 621,194, respectively filed July 17, 1973, May 27, 1970, and Mar. 7, 1967.

This invention relates to a method of making heaters used in electron tubes, and particularly to an improved method of making dark heaters for indirectly-heated cathodes.

It is often said that rates of chemical reactions double with every incremental increase in temperature of 10° C. Consequently, in the electron tube art, where chemical stability is particularly important, any possible reductions in operating temperature are most desirable. Such reductions generally increase both tube life and reliability. Since the cathode heater of the tube runs hotter than any other tube element, it is only natural to attempt to reduce its operating temperature without adversely effecting the cathode electron emission through reduction of the emitter temperature. In so doing, reliability of the heater itself would be enhanced while general tube contamination through deterioration of other elements would be lessened.

Modern indirectly-heated cathodes typically comprise a tungsten or molybdenum heater wire which often is coated with alumina for electrical insulation. Adjacent the heater wire is a cathode base, usually made of nickel, which is coated with an alkaline earth emissive material such as barium oxide, strontium oxide, calcium oxide or combinations thereof. At the elevated temperatures encountered in operating electron tubes, elemental aluminum is slowly produced by chemical reaction between the tungsten or molybdenum heater wire and its alumina coating. The liberated aluminum is vaporized and falls on adjacent tube elements creating interelectrode leakage risks, and producing gas within the tube envelope. The vaporized aluminum also penetrates and defuses through the nickel base of the cathode and forms a thin alumina layer between the nickel base and the emissive coating of the cathode. Since this alumina layer is both electrically and thermally insulative, the cathode deteriorates as the layer forms with time.

Volatile sub-oxides of tungsten or molybdenum are also produced from the chemical reaction between the heater wire and its alumina coating at elevated temperatures thereby also contributing to gas and interelectrode leakage. Where the sub-oxides deposit on the internal surfaces of the nickel cathode base the spectral emissivity of the base increases. Hence, the cathode will increase in temperature with time resulting in a shortening of cathodic life due to more rapid loss of the alkaline earth oxides.

Heretofore in the electron tube field some effort has been devoted towards darkening electrodes in order to improve their capability of transferring heat. Metallic anodes, for example, have been coated with aluminum. The smooth bright aluminum surface has then been heated to convert the bright surface into a rough dark surface which is a more efficient heat radiator than the smooth bright surface. As another example, the surfaces of nickel and iron electron tube elements have been roughened to increase their heat transfer capacity by coating their surfaces with nickel or iron oxides and then reducing the oxide to its metallic state after which finely divided aluminum flakes have been coated onto the sintered reduced metallic surface and heat treated. These prior developments have not, however, proven economical. Furthermore, the chemistry of the tube elements has been altered by these processes through the introduction of extraneous chemical elements.

Accordingly, it is an object of the present invention to provide a method of making an improved heater for an indirectly-heated cathode.

A more particular object of the present invention is to provide a method of making a cathode heater which will operate at a reduced temperature without an accompanying reduction in the temperature of the cathode's emissive material.

Another object of the invention is to provide an inexpensive method of improving the heat transfer character of a cathode heater without the introduction of extraneous chemical elements.

SUMMARY OF THE INVENTION

Briefly described, the present invention is a method of making an improved cathode heater for use in an electron tube comprising the steps of oxidizing the surface of a tungsten or molybdenum wire and reducing the oxide to its metallic state. By this method the surface of the heater wire is roughened and darkened thereby improving its heat radiating character. The heater may be further roughened and darkened by coating the oxidized wire with a soluble salt of a refractory metal. Upon subsequent heating the refractory salt is also reduced.

DESCRIPTION OF THE PREFERRED EMBODIMENTS

Figure 1:
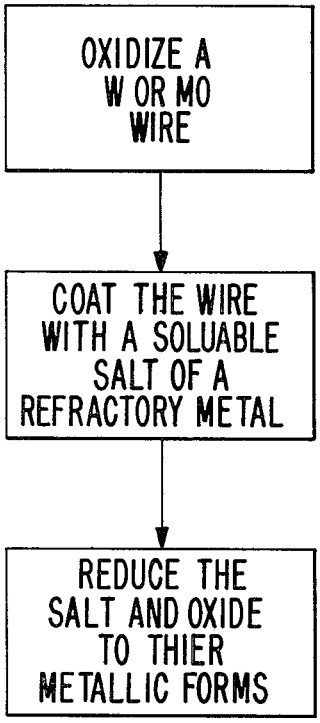
FIG. 1 is a flow diagram of a series of general steps taken in practicing the invention.

Referring now in more detail to the drawing, there is illustrated in FIG. 1 three steps to be taken in practicing the present invention. A tungsten or molybdenum heater wire is first oxidized and then coated with a soluble salt of a refractory metal. The oxide and salt are then reduced to their metallic forms. By this general process the surface of the heater wire is roughened and thereby made less reflective. The heat radiating capability of the wire is accordingly increased since the wire surface now reflects less radiation from within the wire body back into the body.

Figure 2:
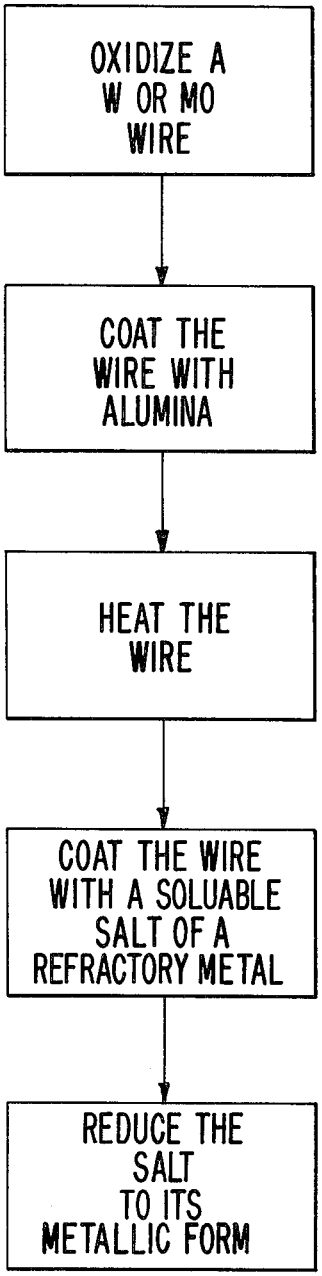
FIG. 2 is another flow diagram of a series of steps in practicing the invention, the first step of which is optional.

The flow diagram of FIG. 2 reiterates the steps in the method of FIG. 1 where an insulated heater wire is to be made. A tungsten or molybdenum wire surface is first oxidized. The wire is then coated with alumina in accordance with standard electron tube industrial practices. Next the alumina-coated wire is heated to sinter the electrically insulating alumina coating to the wire. As the wire has been first oxidized, the refractory oxide is coincidentally reduced to its metalic form thereby producing a roughened and darkened surface which improves the transfer of heat from the wire to the alumina coating. In order to further darken the heater surface the alumina-coated wire is next coated with a soluble salt of a refractory metal. Finally, the salt is reduced to its metallic form. If desired, the oxidation step here may be omitted since an alumina coating itself provides a suitable surface to which a soluble salt will adhere. Furthermore, the heating step, to sinter the alumina coating, may also be omitted, in which case the final firing is conducted at a temperature sufficient to sinter the alumina to the wire, in addition to reducing the oxide and salt. In this latter case, the alumina and the soluble salt solutions may be combined.

Figure 3:
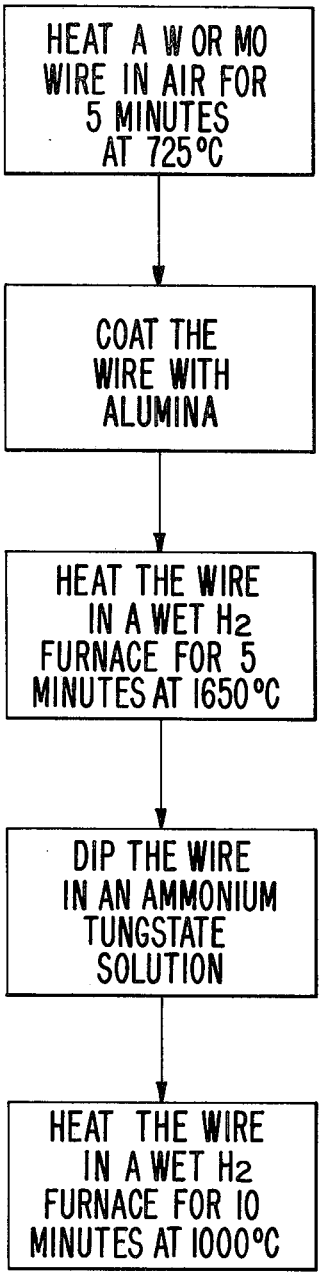
FIG. 3 is a flow diagram illustrating the specific steps of the preferred embodiment of the process which combines the general steps illustrated in FIG. 2.

FIG. 3 illustrates a flow diagram which details a specific embodiment of the more generalized steps shown in FIG. 2. The surface of a tungsten or molybdenum wire is first oxidized by heating the wire in an air atmosphere for 5 minutes at 725° C. The wire is then coated with alumina by cataphoresis or spraying techniques. The coated wire is next fired in a wet hydrogen furnace for 5 minutes at 1650° C. This heat treatment causes the alumina to sinter onto the heater at the same time that the tungsten oxide reduces to its metallic form. The resulting alumina-coated wire has a slight gray color whereas in the prior art the surface of the tungsten under the alumina has been bright. One must thus conclude that the foregoing steps increase the spectral emissivity of the tungsten, and thereby improving the transfer of heat from the heater wire to its electrically insulating coating.

It is possible now to further improve heater radiation by darkening the alumina coating itself. This is done in this particular embodiment by dipping the wire in an ammonium tungstate solution at room temperature. If desired, a spraying technique could be alternatively used. The ammonium tungstate solution may be purchased or prepared by adding concentrated ammonium hydroxide to a 10 percent suspension of tungsten trioxide in distilled water. If capped to prevent loss of ammonia, the solution will not crystallize or precipitate.

After dipping, the heater wire is shaken slightly to remove drops, and dried in an upright position by inserting the heater legs in holes drilled in a plastic block. The heater is dried uniformly without the presence of drops under a heat lamp or at 110° C. in an air oven. Following this step the heated wire is placed in a molybdenum boat and fired for 10 minutes in a wet hydrogen furnace at 1000° C. Upon subsequent cooling the heater is ready for assembly into tube assemblies or cathode subassemblies.

It should be understood that several steps in the various figures may be omitted or combined without rendering the resultant heater inoperative. For example, a completely untreated bare tungsten or molybdenum wire may of course still be used as a cathode heater. Likewise a wire of the same metal having only had an alumina coating sintered thereto is still, of course, an effective insulated cathode heater. To draw upon the present invention one may utilize the teaching of the metal oxidization and reduction method, or the teaching of the coating and reduction of a refractory metal salt on an alumina-coated or oxidized surface, or one may use both teachings. The severity of problems attributable to excessive heat, the degree of technical expertize required, and economic considerations may dictate which teachings are to be drawn upon.

By use of the method illustrated in FIG. 3 a reduction of 200° C. in heater temperature has been achieved in one heater-cathode configuration over that of a standard alumina-coated heater wire with an attendant but surprising 20° C. increase in cathode temperature. It follows that even further reduction in heater temperature can be achieved before the temperature of the cathode falls below that of the standard alumina-coated wire. As the rate of chemical reactions generally halve with each 10° C. reduction in temperature, the vaporization of aluminum and tungsten or molybdenum suboxides from the heater is greatly reduced, resulting in a significant lessening of tube contamination. As alumina had been coated onto a roughened surface, its adherence was also improved, thereby reducing the risk of alumina particles breaking loose under shock or vibration, the presence of which could initiate arcing.

One of the most significant advantages offered by the invention is the non-introduction of extraneous chemical elements. The refractory wire is roughened and darkened by using the wire itself for the complete process. Where the soluable salt, used in the subsequent process of roughening the wire or its alumina coating, is of the same refractory metal as that of the wire, the metal dispersed throughout the alumina is the same as that of the wire. Where an ammonium tungstate solution is used, for example, it is believed that the solution impregnates the alumina coating. In the furnace it decomposed to ammonia gas, water vapor, and tungsten oxides. In the hydrogen hot zone of the furnace the tungsten oxide is reduced to finally divide and disperse tungsten throughout the alumina thereby increasing the spectral emissivity of the alumina. Thus the end product produced by this very economical method is composed merely of tungsten metal and alumina.

What is claimed is:

1. A method for the manufacture of a heater for an indirectly heated cathode of an electron tube which comprises:
   (a) oxidizing the surface of a heater wire in the presence of an oxidizing gas to form an oxidized exposed surface on said wire, said wire being composed of a refractory metal selected from the group consisting of tungsten and molybdenum; and
   (b) reducing the exposed oxidized surface of the wire formed by step (a) to the metallic state of the refractory metal to form a rough, black surface on the wire, step (b) being the final step for forming the heater for the indirectly heated cathode.

2. A method for the manufacture of a heater for an indirectly heated cathode of an electron tube which comprises the steps of:
   (a) oxidizing the surface of a heater wire by heating the wire in the presence of an oxidizing gas to form an exposed oxidized surface on said wire, said wire being composed of a refractory metal selected from the group consisting of tungsten and molybdenum;
   (b) coating the exposed oxidized surface of the wire with alumina;
   (c) heating the coated wire in the presence of hydrogen to reduce the refractory oxides on the surface of the wire and to sinter the alumina to the wire to form a resulting wire;
   (d) coating the resulting wire with a soluble salt of a refractory metal; and
   (e) heating the wire formed by step (d) in a reducing atmosphere to form a rough, black surface on the wire.

3. The method of claim 2 wherein the soluble salt is ammonium tungstate.

4. The method of claim 2 wherein the wire is composed of tungsten.

5. The method of claim 2 wherein the refractory metal of the salt and wire are the same.

6. A method for the manufacture of a heater for an indirectly heated cathode of an electron tube which comprises:

(a) oxidizing the surface of a heater wire by heating the wire in the presence of an oxidizing gas to form an exposed oxidized surface on said wire, said wire being composed of a refractory metal selected from the group consisting of tungsten and molybdenum;

(b) coating the exposed oxidized wire with a soluble salt of a refractory metal; and (c) reducing the coating and the oxidized surface of the wire in the presence of hydrogen to their metallic states to form a rough, black surface on the wire.

7. The method of claim 6 wherein the soluble salt is ammonium tungstate.

8. The method of claim 7 wherein, following step (a), the oxidized wire is coated with alumina and wherein, during step (c), the coated oxidized wire is heated sufficiently to sinter the alumina coating to the wire as well as to reduce the oxidized wire and ammonium tungstate to their metallic states.

* * * * *